US012680484B2

(12) United States Patent
Lee et al.

(10) Patent No.: US 12,680,484 B2
(45) Date of Patent: Jul. 14, 2026

(54) ACOUSTIC METAMATERIAL-BASED MUFFLER FOR BROADBAND EXHAUST NOISE REDUCTION OF INTERNAL COMBUSTION ENGINES

(71) Applicant: AJOU UNIVERSITY INDUSTRY-ACADEMIC COOPERATION FOUNDATION, Suwon-si (KR)

(72) Inventors: Jin Woo Lee, Suwon-si (KR); Jae Ho Cho, Seoul (KR)

(73) Assignee: AJOU UNIVERSITY INDUSTRY-ACADEMIC COOPERATION FOUNDATION, Suwon-si (KR)

( * ) Notice: Subject to any disclaimer, the term of this patent is extended or adjusted under 35 U.S.C. 154(b) by 153 days.

(21) Appl. No.: 18/436,184

(22) Filed: Feb. 8, 2024

(65) Prior Publication Data

US 2025/0257675 A1 Aug. 14, 2025

(51) Int. Cl.
*F01N 1/02* (2006.01)

(52) U.S. Cl.
CPC ..... *F01N 1/02* (2013.01); *F01N 1/026* (2013.01)

(58) Field of Classification Search
CPC ..... F01N 1/02; F01N 1/026; F01N 2490/15; F01N 2490/155
See application file for complete search history.

(56) References Cited

U.S. PATENT DOCUMENTS 969,225 A * 9/1910 Walstrom ..... F01N 1/166 181/254
1,532,928 A * 4/1925 O'Connor ..... F01N 1/08 181/275
1,874,326 A * 8/1932 Mason ..... F01N 1/006 181/255

(Continued)

FOREIGN PATENT DOCUMENTS

CN 106205591 A 12/2016
DE 4327562 A1 * 2/1995 ..... F01N 1/02

(Continued)

OTHER PUBLICATIONS

English translation of WO 2022092646 A1, accessed Oct. 31, 2025 via Espacenet <https://translationportal.epo.org/emtp/translate/?ACTION=description-retrieval&COUNTRY=WO&ENGINE=google&FORMAT=docdb&KIND=A1&LOCALE=en_EP&NUMBER=2022092646&SRCLANG=ko&TRGLANG=en> (Year: 2022).*

*Primary Examiner* — Jeremy A Luks
(74) *Attorney, Agent, or Firm* — NSIP Law

(57) ABSTRACT

The present disclosure provides an acoustic metamaterial-based muffler for broadband exhaust noise reduction of internal combustion engines is mounted on an exhaust pipe of an internal combustion engine, and includes an exhaust flow pipe that is formed of an inlet on one side through which exhaust of the internal combustion engine flows in, an outlet on the other side through which the exhaust flows out, and a flow passage on the inside through which the exhaust flows from one side to the other side; and a plurality of noise reduction units that are provided inside along a longitudinal direction of the exhaust flow pipe to attenuate noise in the corresponding frequency band among the exhaust noises flowing along the exhaust flow pipe.

13 Claims, 7 Drawing Sheets

(56) References Cited

U.S. PATENT DOCUMENTS 1,910,672 A * 5/1933 Bourne ..... F01N 1/02 381/353
2,056,608 A * 10/1936 Jack ..... F01N 1/023 181/248
2,101,460 A * 12/1937 Schmidt ..... F01N 1/04 181/252
2,150,768 A * 3/1939 Gale ..... F01N 1/089 181/275
2,184,891 A * 12/1939 Bourne ..... F01N 1/02 181/273
2,213,614 A * 9/1940 Scarritt ..... F01N 13/18 181/255
2,233,804 A * 3/1941 Bourne ..... F16L 55/033 138/30
RE22,283 E * 3/1943 Bourne ..... F01N 1/04 181/248
2,326,612 A * 8/1943 Bourne ..... F01N 1/04 181/252
2,903,085 A * 9/1959 Miller ..... F01N 1/089 181/255
3,754,619 A * 8/1973 McCormick ..... F01N 1/04 422/607
4,094,644 A * 6/1978 Wagner ..... F01N 1/08 422/181
5,245,140 A * 9/1993 Wu ..... F01N 1/02 181/232
7,600,607 B2 * 10/2009 Sullivan ..... H10N 10/13 181/278
7,905,319 B2 * 3/2011 Sullivan ..... F01N 1/086 181/232
8,210,309 B1 * 7/2012 Schlosser ..... F01N 1/026 181/227
11,761,411 B2 * 9/2023 Kim ..... F02M 35/1272 118/212
2015/0345497 A1 * 12/2015 Lucas ..... F04B 39/0027 418/205
2018/0080354 A1 * 3/2018 Smith ..... F01N 13/08
2020/0018204 A1 * 1/2020 Brockway ..... F01N 1/06
2023/0184147 A1 * 6/2023 An ..... F02M 35/1266 181/250
2024/0167403 A1 * 5/2024 Lee ..... F01N 1/02
2025/0140227 A1 * 5/2025 Lee ..... G10K 11/172

FOREIGN PATENT DOCUMENTS

KR 20160143124 A * 12/2016 ..... F02M 35/1255
KR 10-2022-0056678 A 10/2020
KR 10-2022-0056679 A 5/2022
KR 20220056677 A * 5/2022 ..... F02M 35/1266
WO WO-2007101412 A1 * 9/2007 ..... F01N 1/003
WO WO-2022092646 A1 * 5/2022 ..... F02M 35/1266

* cited by examiner

ACOUSTIC METAMATERIAL-BASED MUFFLER FOR BROADBAND EXHAUST NOISE REDUCTION OF INTERNAL COMBUSTION ENGINES

BACKGROUND

1. Field

The present disclosure relates to an acoustic metamaterial-based muffler for broadband exhaust noise reduction of internal combustion engines, and more specifically, to an acoustic metamaterial-based muffler for broadband exhaust noise reduction of internal combustion engines in which a plurality of noise reduction units that attenuate exhaust noise in the corresponding frequency band are arranged in a straight pipe structure where centers of an inlet through which exhaust flows in and an outlet through which exhaust flows out coincide, and a plurality of walls forming the noise reduction units attenuate exhaust noise in the corresponding frequency band to reduce exhaust noise without interfering the flow of exhaust.

2. Description of the Related Art

In general, exhaust sound from a mechanical device powered by an internal combustion engine, such as a vehicle, is a source of noise in everyday life.

For the purpose of reducing exhaust noise generated from the power device of the internal combustion engine, a muffler is used to reduce noise.

Conventionally, many companies and organizations have reported research results on noise reduction devices for engines with a displacement equivalent to that of commercial vehicles.

On the other hand, development of an exhaust noise reduction device related to a mechanical device that uses a large internal combustion engine such as a large diesel generator and a combat vehicle as a power source is insufficient.

Most exhaust noise reduction devices of commercial vehicles on the market have complex internal structures, and a decrease in engine efficiency due to a pressure drop caused by the noise reduction device having such a structure is inevitable.

In this case, the higher the displacement of the mechanical device, the more sensitive it is to the pressure drop due to the complex internal structure of the exhaust noise reduction device, and requires a large diameter pipe size is required compared to passenger vehicles.

The muffler of the passenger vehicle uses a pipe with a diameter of about 5 cm due to exhaust characteristics, and a high-displacement mechanical device using a large engine such as a generator and a combat vehicle requires a pipe several times larger than this.

Generally, as the size of the pipe increases, the size of the installed muffler also increases, which may cause installation space problems.

In addition, the size of an outer cylinder must be small due to constraints related to installation space, and in such a structure, it is difficult to implement a wide noise reduction band with a single unit structure.

For prior art, refer to Korean Patent Application Laid-open Publication No. 10-2013-0064299 (Jun. 18, 2013).

SUMMARY

The present disclosure provides an acoustic metamaterial-based muffler for broadband exhaust noise reduction of internal combustion engines in which a plurality of noise reduction units that attenuate exhaust noise in the corresponding frequency band form a straight pipe structure where centers of an inlet through which exhaust flows in and an outlet through which exhaust flows out coincide to be arranged in a structure in which a plurality of Helmholtz resonators are connected in series and a ¼ wave tube structure, and thereby a plurality of walls forming the noise reduction units attenuate exhaust noise in the corresponding frequency band to have an exhaust noise reduction band wider than that of the prior art without interfering the flow of exhaust.

An acoustic metamaterial-based muffler for broadband exhaust noise reduction of internal combustion engines according to the present disclosure is mounted on an exhaust pipe of an internal combustion engine, and includes an exhaust flow pipe that is formed of an inlet on one side through which exhaust of the internal combustion engine flows in, an outlet on the other side through which the exhaust flows out, and a flow passage on the inside through which the exhaust flows from one side to the other side; and a plurality of noise reduction units that are provided inside along a longitudinal direction of the exhaust flow pipe to attenuate noise in the corresponding frequency band among the exhaust noises flowing along the exhaust flow pipe.

In this case, the plurality of noise reduction units according to the present disclosure includes a first noise reduction unit that attenuates exhaust noise in the frequency bands of 296 to 367 Hz, 374 to 804 Hz, 962 to 1349 Hz, 1401 to 1784 Hz, and 1824 to 2000 Hz among the frequency ranges of 1 to 2000 Hz, a second noise reduction unit that attenuates exhaust noise in the frequency bands of 368 to 373 Hz, 805 to 882 Hz, 1350 to 1400 Hz, and 1785 to 1823 Hz among the frequency bands in which the noise reduction band of the first noise reduction unit is not formed, a third noise reduction unit that attenuates exhaust noise in the frequency band of 883 to 961 Hz among the frequency bands in which the noise reduction bands of the first and second noise reduction units are not formed, a fourth noise reduction unit that attenuates exhaust noise in the frequency band of 277 to 295 Hz among the frequency bands in which the noise reduction bands of the first, second, and third noise reduction units are not formed, and a fifth noise reduction unit that attenuates exhaust noise in the frequency band of 102 to 276 Hz among the frequency bands in which the noise reduction bands of the first, second, third, and fourth noise reduction units are not formed.

Here, the first noise reduction unit according to the present disclosure includes a first front outer wall that is formed orthogonal to a longitudinal direction of the exhaust flow pipe, a first rear outer wall that is spaced apart from the first front outer wall at a certain distance, and formed orthogonal to the longitudinal direction of the exhaust flow pipe, a 1-1 inner wall that is formed at ends of the first front outer wall and the first rear outer wall to have a length toward an inner center between the first front outer wall and the first rear outer wall, and of which length is parallel to the longitudinal direction of the exhaust flow pipe, a 1-2 inner wall that is spaced apart from the 1-1 inner wall at a corresponding distance in an outer circumferential direction on the inside between the first front outer wall and the first rear outer wall, and is formed to have a length toward an inner center between the first front outer wall and the first rear outer wall, and of which length is parallel to a length of the 1-1 inner wall, a 1-3 inner wall that is spaced apart from the 1-2 inner wall at a corresponding distance in the outer circumferential direction on the inside between the first front outer wall and the first rear outer wall, and is formed to have a length toward the inner center between the first front outer wall and the first rear outer wall, and of which length is parallel to the length of the 1-1 inner wall, and a 1-4 inner wall that is spaced apart from the 1-3 inner wall at a corresponding distance in the outer circumferential direction on the inside between the first front outer wall and the first rear outer wall, and is formed to have a length toward the inner center of the first front outer wall and the first rear outer wall, and of which length is parallel to the length of the 1-1 inner wall.

In this case, the separation distance between the first front outer wall and the first rear outer wall according to the present disclosure is 104 mm, and the length of the 1-1 inner wall is 8 mm, the length of the 1-2 inner wall is 14 mm and the separation distance from the 1-1 inner wall is 26 mm based on the 1-1 inner wall, the length of the 1-3 inner wall is 42 mm and the separation distance from the 1-1 inner wall is 62 mm based on the 1-1 inner wall, and the length of the 1-4 inner wall is 46 mm and the separation distance from the 1-1 inner wall is 76 mm based on the 1-1 inner wall.

In addition, the second noise reduction unit according to the present disclosure includes a second front outer wall that is formed orthogonal to a longitudinal direction of the exhaust flow pipe, a second rear outer wall that is spaced apart from the second front outer wall at a certain distance, and formed orthogonal to the longitudinal direction of the exhaust flow pipe, a 2-1 inner wall that is formed at ends of the second front outer wall and the second rear outer wall to have a length toward an inner center between the second front outer wall and the second rear outer wall, and of which length is parallel to the longitudinal direction of the exhaust flow pipe, a 2-2 inner wall that is spaced apart from the 2-1 inner wall at a corresponding distance in an outer circumferential direction on the inside between the second front outer wall and the second rear outer wall, and is formed to have a length toward an inner center between the second front outer wall and the second rear outer wall, and of which length is parallel to the length of the 2-1 inner wall, a 2-3 inner wall that is spaced apart from the 2-2 inner wall at a corresponding distance in the outer circumferential direction on the inside between the second front outer wall and the second rear outer wall, and is formed to have a length toward the inner center between the second front outer wall and the second rear outer wall, and of which length is parallel to the length of the 2-1 inner wall, and a 2-4 inner wall that is spaced apart from the 2-3 inner wall at a corresponding distance in the outer circumferential direction on the inside between the second front outer wall and the second rear outer wall, and is formed to have a length toward the inner center of the second front outer wall and the second rear outer wall, and of which length is parallel to the length of the 2-1 inner wall.

In this case, the separation distance between the second front outer wall and the second rear outer wall according to the present disclosure is 144 mm, and the length of the 2-1 inner wall is 24 mm, the length of the 2-2 inner wall is 20 mm and the separation distance from the 2-1 inner wall is 16 mm based on the 2-1 inner wall, the length of the 2-3 inner wall is 20 mm and the separation distance from the 2-1 inner wall is 112 mm based on the 2-1 inner wall, and the length of the 2-4 inner wall is 56 mm and the separation distance from the 2-1 inner wall is 124 mm based on the 2-1 inner wall.

In addition, the third noise reduction unit according to the present disclosure includes a third front outer wall that is formed orthogonal to a longitudinal direction of the exhaust flow pipe, a third rear outer wall that is spaced apart from the third front outer wall at a certain distance, and formed orthogonal to the longitudinal direction of the exhaust flow pipe, a 3-1 inner wall that is formed at ends of the third front outer wall and the third rear outer wall to have a length toward an inner center between the third front outer wall and the third rear outer wall, and of which length is parallel to the longitudinal direction of the exhaust flow pipe, and a 3-2 inner wall that is spaced apart from the 3-1 inner wall at a corresponding distance in an outer circumferential direction on the inside between the third front outer wall and the third rear outer wall, and is formed to have a length toward an inner center between the third front outer wall and the third rear outer wall, and of which length is parallel to the length of the 3-1 inner wall.

In this case, it is preferable that the separation distance between the third front outer wall and the third rear outer wall according to the present disclosure is 184 mm, and the length of the 3-1 inner wall is 34 mm, and the length of the 3-2 inner wall is 52 mm and the separation distance from the 3-1 inner wall is 154 mm based on the 3-1 inner wall.

In addition, the fourth noise reduction unit according to the present disclosure includes a fourth front outer wall that is formed orthogonal to a longitudinal direction of the exhaust flow pipe, a fourth rear outer wall that is spaced apart from the fourth front outer wall at a certain distance, and formed orthogonal to the longitudinal direction of the exhaust flow pipe, a 4-1 inner wall that is formed at ends of the fourth front outer wall and the fourth rear outer wall to have a length toward an inner center between the fourth front outer wall and the fourth rear outer wall, and of which length is parallel to the longitudinal direction of the exhaust flow pipe, a 4-2 inner wall that is spaced apart from the 4-1 inner wall at a corresponding distance in an outer circumferential direction on the inside between the fourth front outer wall and the fourth rear outer wall, and is formed to have a length toward an inner center between the fourth front outer wall and the fourth rear outer wall, and of which length is parallel to the length of the 4-1 inner wall, a 4-3 inner wall that is spaced apart from the 4-2 inner wall at a corresponding distance in the outer circumferential direction on the inside between the fourth front outer wall and the fourth rear outer wall, and is formed to have a length toward the inner center between the fourth front outer wall and the fourth rear outer wall, and of which length is parallel to the length of the 4-1 inner wall, and a 4-4 inner wall that is spaced apart from the 4-3 inner wall at a corresponding distance in the outer circumferential direction on the inside between the fourth front outer wall and the fourth rear outer wall, and is formed to have a length toward the inner center of the fourth front outer wall and the fourth rear outer wall, and of which length is parallel to the length of the 4-1 inner wall.

In this case, it is preferable that the separation distance between the fourth front outer wall and the fourth rear outer wall according to the present disclosure is 188 mm, and the length of the 4-1 inner wall is 42 mm, the length of the 4-2 inner wall is 18 mm and the separation distance from the 4-1 inner wall is 68 mm based on the 4-1 inner wall, the length of the 4-3 inner wall is 66 mm and the separation distance from the 4-1 inner wall is 120 mm based on the 4-1 inner wall, and the length of the 4-4 inner wall is 78 mm and the separation distance from the 4-1 inner wall is 128 mm based on the 4-1 inner wall.

In addition, the fifth noise reduction unit according to the present disclosure includes a fifth front outer wall that is formed orthogonal to a longitudinal direction of the exhaust flow pipe, a fifth rear outer wall that is spaced apart from the fifth front outer wall at a certain distance, and formed orthogonal to the longitudinal direction of the exhaust flow pipe, a 5-1 inner wall that is formed at ends of the fifth front outer wall and the fifth rear outer wall to have a length toward an inner center between the fifth front outer wall and the fifth rear outer wall, and of which length is parallel to the longitudinal direction of the exhaust flow pipe, and a 5-2 inner wall that is formed at the end of the 5-1 inner wall to have a length toward the inside between the fifth front outer wall and the fifth rear outer wall, and of which length is parallel to the lengths of the fifth front outer wall and the fifth rear outer wall.

In this case, it is preferable that the separation distance between the fifth front outer wall and the fifth rear outer wall according to the present disclosure is 392 mm, and the length of the 5-1 inner wall is 182 mm, and the length of the 5-2 inner wall is 54 mm.

In addition, each of the first to fifth noise reduction units according to the present disclosure may be provided as a pair.

In addition, the first noise reduction unit, the second noise reduction unit, the third noise reduction unit, the fourth noise reduction unit, and the fifth noise reduction unit according to the present disclosure may be provided in that order.

In addition, the noise reduction unit according to the present disclosure may be provided with only one noise reduction unit selected from the first to fifth noise reduction units.

In addition, the noise reduction unit according to the present disclosure may be provided with only two or more noise reduction units selected from the first to fifth noise reduction units.

The effects exhibited by the acoustic metamaterial-based muffler for broadband exhaust noise reduction of internal combustion engines according to the present disclosure are as follows.

A plurality of noise reduction units that attenuate exhaust noise in the corresponding frequency band form a straight pipe structure where centers of an inlet through which exhaust flows in and an outlet through which exhaust flows out coincide to be arranged in a structure in which a plurality of Helmholtz resonators are connected in series and a ¼ wave tube structure, and thereby a plurality of walls forming the noise reduction units attenuate exhaust noise in the corresponding frequency band to have an exhaust noise reduction band wider than that of the prior art without interfering the flow of exhaust.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
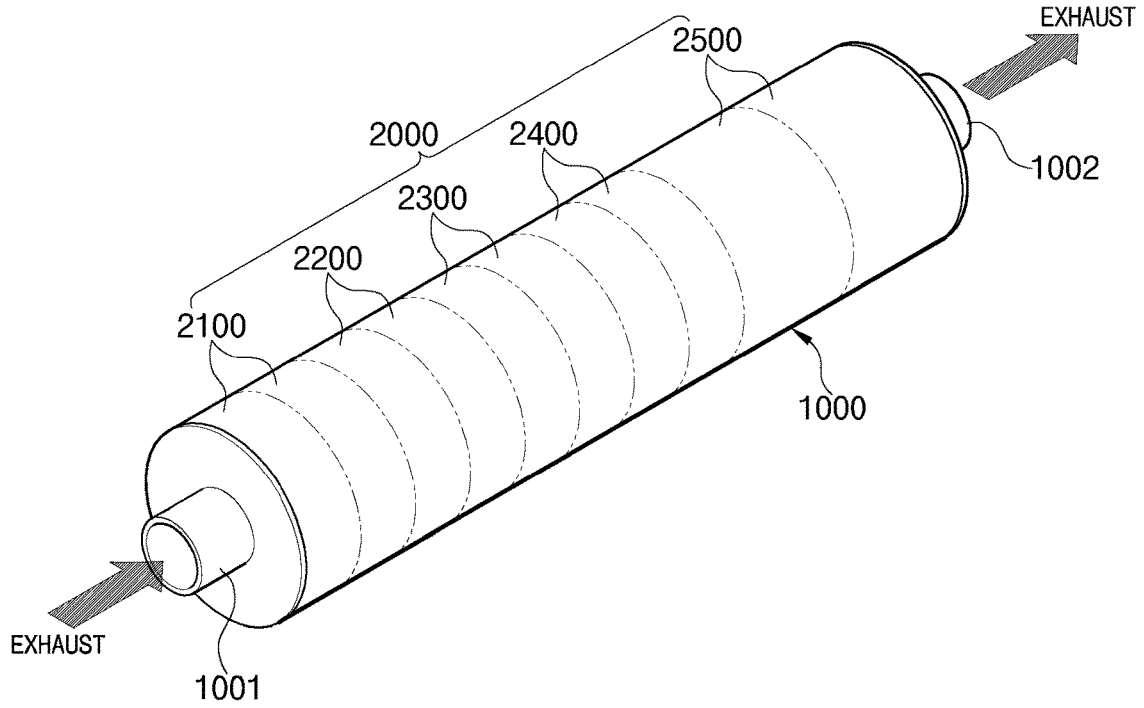
FIG. 1 is a perspective view illustrating an acoustic metamaterial-based muffler for broadband exhaust noise reduction of internal combustion engines according to an embodiment of the present disclosure.
Figure 2:
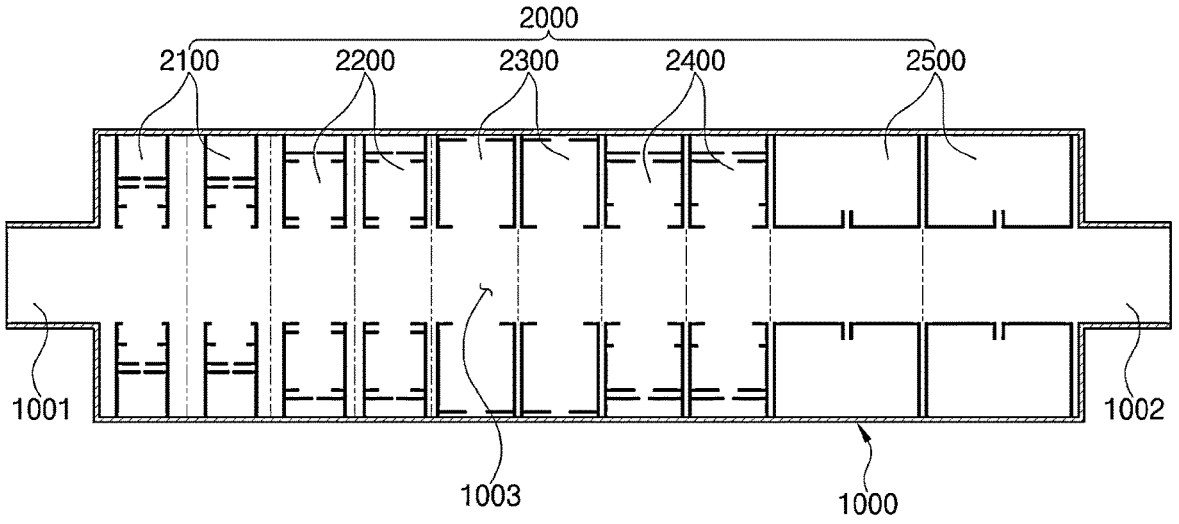
FIG. 2 is a sectional view illustrating the acoustic metamaterial-based muffler for broadband exhaust noise reduction of internal combustion engines according to an embodiment of the present disclosure.

Hereinafter, preferred embodiments according to the present disclosure will be described in detail with reference to the attached drawings. Prior to this, the terms or words used in this specification and claims should not be construed as limited to their usual or dictionary meanings, and the inventor should appropriately define the concept of terms in order to explain his or her invention in the best way. Based on the principle of definability, it must be interpreted with meaning and concept consistent with the technical idea of the present disclosure.

Therefore, the embodiments described in this specification and the configurations illustrated in the drawings are only the most preferred embodiments of the present disclosure, and do not represent the entire technical idea of the present disclosure, so it should be understood that at the time of filing this application, there may be equivalent variations that may be replaced.

First, a metamaterial is a material artificially designed to have unique properties that cannot be found in the natural world, and the metamaterial is composed of a repeating arrangement of units.

An acoustic metamaterial may control wave energy such as sound waves, and acoustic properties of the acoustic metamaterial may be known from a dispersion curve obtained through acoustic analysis of the unit, and a band gap, which is a section where the wave number becomes an imaginary number, coincides with a noise reduction band.

In other words, the band gap section becomes a frequency section where transmitted noise is reduced compared to incident noise when implementing the acoustic metamaterial by repeating the arrangement of the units.

The present disclosure relates to an acoustic metamaterial-based muffler for broadband exhaust noise reduction of internal combustion engines in which a plurality of noise reduction units that attenuate exhaust noise in the corresponding frequency band are arranged in a straight pipe structure where centers of an inlet through which exhaust flows in and an outlet through which exhaust flows out coincide, and a plurality of walls forming the noise reduction units attenuate exhaust noise in the corresponding frequency band to reduce exhaust noise without interfering the flow of exhaust, and is described with reference to the drawings as follows.

The acoustic metamaterial-based muffler for broadband exhaust noise reduction of internal combustion engines according to an embodiment of the present disclosure with reference to FIGS. 1 to 14 is mounted on an exhaust pipe of a large internal combustion engine, and includes an exhaust flow pipe 1000 and a plurality of noise reduction units 2000, in which the exhaust flow pipe 1000 is formed of an inlet 1001 on one side through which exhaust of the internal combustion engine flows in, an outlet 1002 on the other side through which the exhaust flows out, and a flow passage 1003 on the inside through which the exhaust flows from one side to the other side.

In this case, the exhaust flow pipe 1000 has a straight pipe shape with a circular circumference, and diameters of the inlet 1001 through which the exhaust flows in and the outlet 1002 through which the exhaust flows out are desirably smaller than a diameter of the exhaust flow pipe 1000.

In addition, the plurality of noise reduction units 2000 are provided along a longitudinal direction of the exhaust flow pipe 1000 to attenuate noise in the corresponding frequency band among the exhaust noises flowing along the exhaust flow pipe 1000.

The noise reduction unit 2000 includes a total of 5 types of a first noise reduction unit 2100, a second noise reduction unit 2200, a third noise reduction unit 2300, a fourth noise reduction unit 2400, and a fifth noise reduction unit 2500, and each pair is arranged to form a muffler.

In this case, internal structural dimensions of the five types of noise reduction units 2100, 2200, 2300, 2400, and 2500 may be set differently to each other so that band gaps of the respective noise reduction units 2100, 2200, 2300, 2400, and 2500 do not coincide.

In addition, the above-mentioned noise reduction units 2000 do not necessarily need to be of the five types, and even if the noise reduction units 2000 are provided with two or more types which are selected from the five types of the noise reduction units 2100, 2200, 2300, 2400, and 2500, the broadband noise reduction band may be achieved by providing the noise reduction units 2000 with differently set band gaps.

With reference to FIGS. 3 to 12, each of the noise reduction units 2100, 2200, 2300, 2400, and 2500 according to an embodiment of the present disclosure will be described in more detail as follows.

Figure 3:
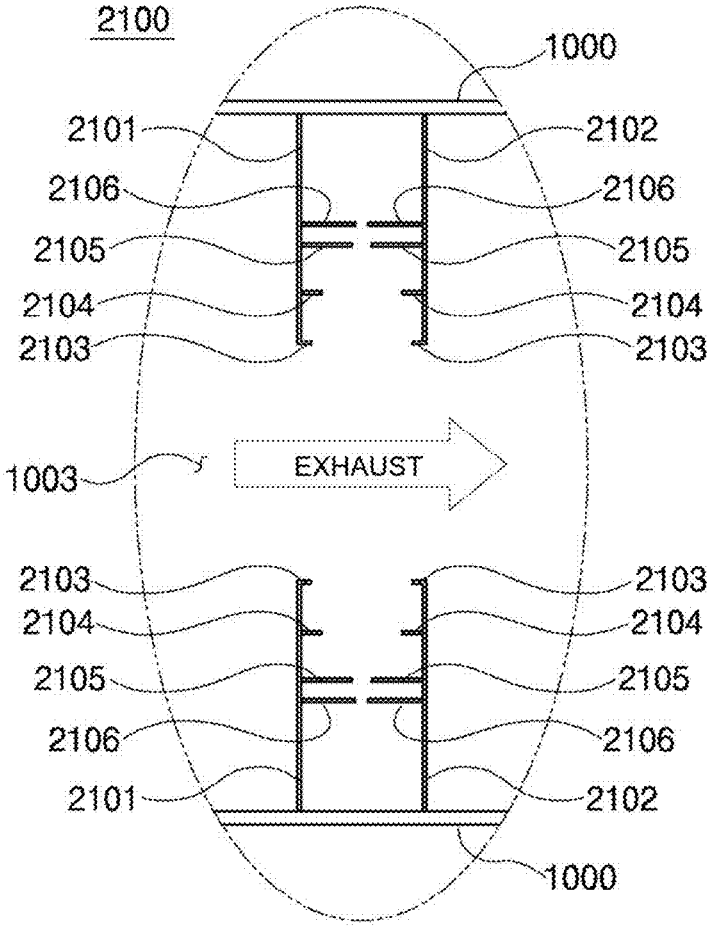
FIG. 3 is a sectional view illustrating a cross-section of a first noise reduction unit according to an embodiment of the present disclosure.
Figure 4:
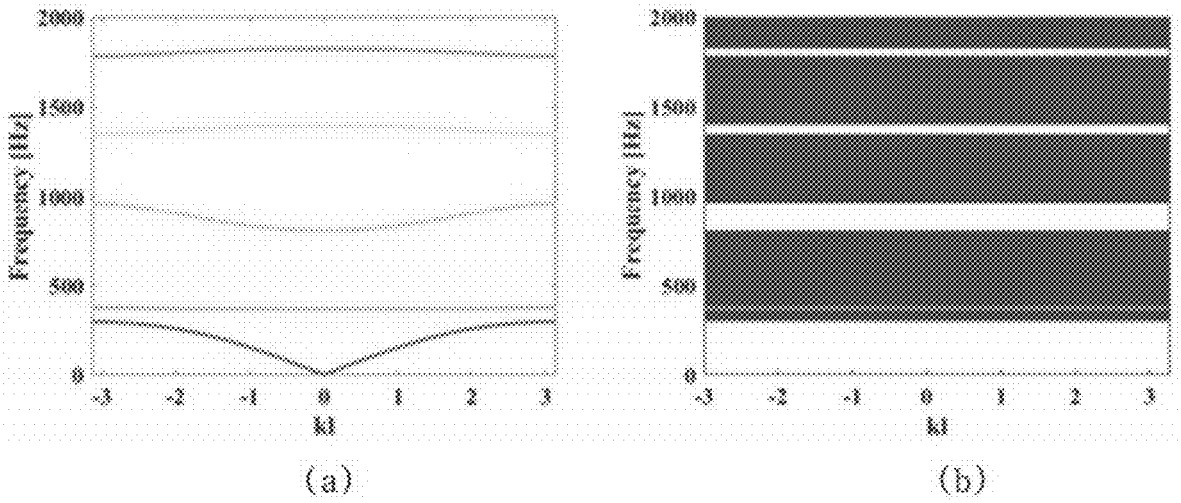
FIG. 4 is a graph illustrating analysis results of a dispersion curve (a) and a band cap (b) of the first noise reduction unit according to an embodiment of the present disclosure.

First, the first noise reduction unit 2100 with reference to FIGS. 3 and 4 attenuates exhaust noise in frequency bands of 296 to 367 Hz, 374 to 804 Hz, 962 to 1349 Hz, 1401 to 1784 Hz, and 1824 to 2000 Hz among the frequency ranges of 1 to 2000 Hz.

In this case, the first noise reduction unit 2100 includes a first front outer wall 2101, a first rear outer wall 2102, a 1-1 inner wall 2103, a 1-2 inner wall 2104, a 1-3 inner wall 2105, and a 1-4 inner wall 2106. The number, position, and length of the inner walls are only examples, and the number of inner walls is not limited to 4 according to design conditions of the muffler, and may be adjusted in various ways to be more or less than that.

As an example of the first noise reduction unit 2100, it is preferable that the first front outer wall 2101 is formed orthogonal to a longitudinal direction of the exhaust flow pipe 1000, the first rear outer wall 2102 is formed to be spaced apart from the first front outer wall 2101 at a certain distance, and the first rear outer wall 2102 is also formed orthogonal to the longitudinal direction of the exhaust flow pipe 1000.

In this case, it is preferable that the separation distance between the first front outer wall 2101 and the first rear outer wall 2102 is 104 mm, and an annular disk is formed at the center of the first front outer wall 2101 and the first rear outer wall 2102 to allow the exhaust to flow.

In addition, the 1-1 inner wall 2103 is formed at the ends of the first front outer wall 2101 and the first rear outer wall 2102 to have a length toward the inner center of the first front outer wall 2101 and the first rear outer wall 2102, and its length is parallel to the longitudinal direction of the exhaust flow pipe 1000.

In this case, it is preferable that the length of the 1-1 inner wall 2103 is 8 mm, and wave energy such as sound waves of exhaust flowing along the exhaust passage is incident between the 1-1 inner walls 2103 formed at the ends of the first front outer wall 2101 and the first rear outer wall 2102, respectively.

The 1-2 inner wall 2104 is spaced apart from the 1-1 inner wall 2103 at a corresponding distance in the outer circumferential direction on the inside between the first front outer wall 2101 and the first rear outer wall 2102, and is formed to have a length toward the inner center of the first front outer wall 2101 and the first rear outer wall 2102, and its length is parallel to the length of the 1-1 inner wall 2103.

In this case, it is preferable that the length of the 1-2 inner wall 2104 is 14 mm, the separation distance from the 1-1 inner wall 2103 is 26 mm based on the 1-1 inner wall 2103, and wave energy such as sound waves of exhaust passing between the 1-1 inner walls 2103 is incident between the 1-2 inner walls 2104 formed on the inner surfaces of the first front outer wall 2101 and the first rear outer wall 2102, respectively.

The 1-3 inner wall 2105 is spaced apart from the 1-2 inner wall 2104 at a corresponding distance in the outer circumferential direction on the inside between the first front outer wall 2101 and the first rear outer wall 2102, and is formed to have a length toward the inner center of the first front outer wall 2101 and the first rear outer wall 2102, and its length is parallel to the length of the 1-1 inner wall 2103.

In this case, it is preferable that the length of the 1-3 inner wall 2105 is 42 mm, the separation distance from the 1-1 inner wall 2103 is 62 mm based on the 1-1 inner wall 2103, and wave energy such as sound waves of exhaust passing between the 1-3 inner walls 2105 is incident between the 1-3 inner walls 2105 formed on the inner surfaces of the first front outer wall 2101 and the first rear outer wall 2102, respectively.

The 1-4 inner wall 2106 is spaced apart from the 1-3 inner wall 2105 at a corresponding distance in the outer circumferential direction on the inside between the first front outer wall 2101 and the first rear outer wall 2102, and is formed to have a length toward the inner center of the first front outer wall 2101 and the first rear outer wall 2102, and its length is parallel to the length of the 1-1 inner wall 2103.

In this case, it is preferable that the length of the 1-4 inner wall 2106 is 46 mm, the separation distance from the 1-1 inner wall 2103 is 76 mm based on the 1-1 inner wall 2103, and wave energy such as sound waves of exhaust passing between the 1-3 inner walls 2105 is incident between the 1-4 inner walls 2106 formed on the inner surfaces of the first front outer wall 2101 and the first rear outer wall 2102, respectively.

Therefore, the lengths of the 1-1 inner wall 2103, the 1-2 inner wall 2104, the 1-3 inner wall 2105, and the 1-4 inner wall 2106 are parallel to each other, and the above-described inner walls are formed on the first front outer wall 2101 and the first rear outer wall 2102, respectively, and are bilaterally symmetrical based on the inner center of the first front outer wall 2101 and the first rear outer wall 2102.

In addition, as described above, it is preferable that the 1-1 inner wall 2103, the 1-2 inner wall 2104, the 1-3 inner wall 2105, and the 1-4 inner wall 2106 of the first noise reduction unit 2100 are axially symmetrical having a shape rotated about the central axis of the exhaust flow pipe 1000.

In addition, the cavity divided by the 1-1 inner wall 2103, the 1-2 inner wall 2104, the 1-3 inner wall 2105, and the 1-4 inner wall 2106 may be formed of a structure in which a plurality of Helmholtz resonators are connected in series and a ¼ wave tube structure to reduce exhaust noise.

Therefore, FIG. 4 illustrates a dispersion curve and a band gap section according to the first noise reduction unit 2100, and the first noise reduction unit 2100 forms noise reduction bands in the ranges of 296 to 367 Hz, 374 to 804 Hz, 962 to 1349 Hz, 1401 to 1784 Hz, and 1824 to 2000 Hz among the frequency bands of 1 to 2000 Hz, thereby reducing exhaust noise by attenuating the exhaust noise in the corresponding frequency bands.

Figure 5:
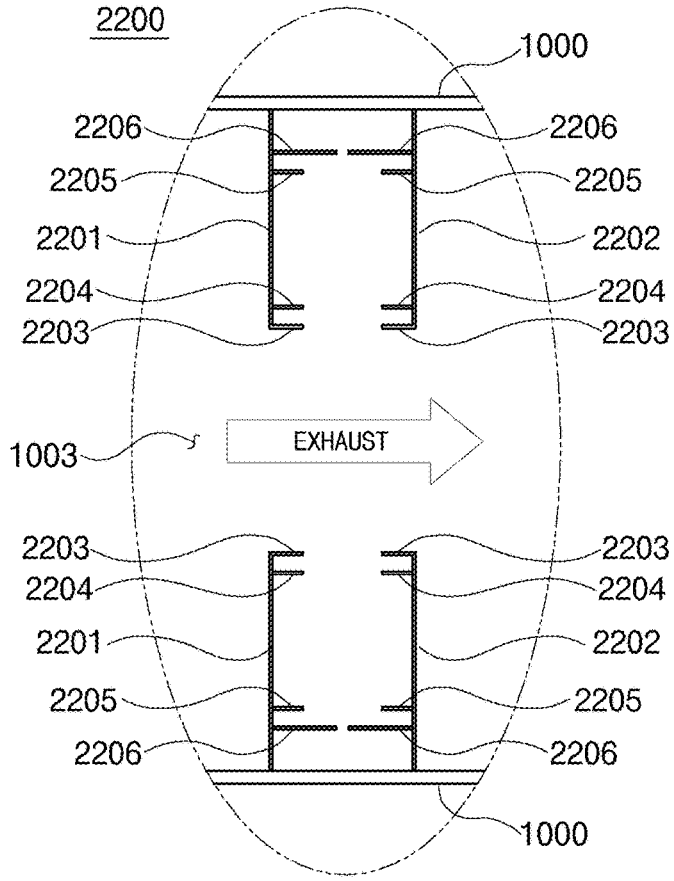
FIG. 5 is a sectional view illustrating a cross-section of a second noise reduction unit according to an embodiment of the present disclosure.
Figure 6:
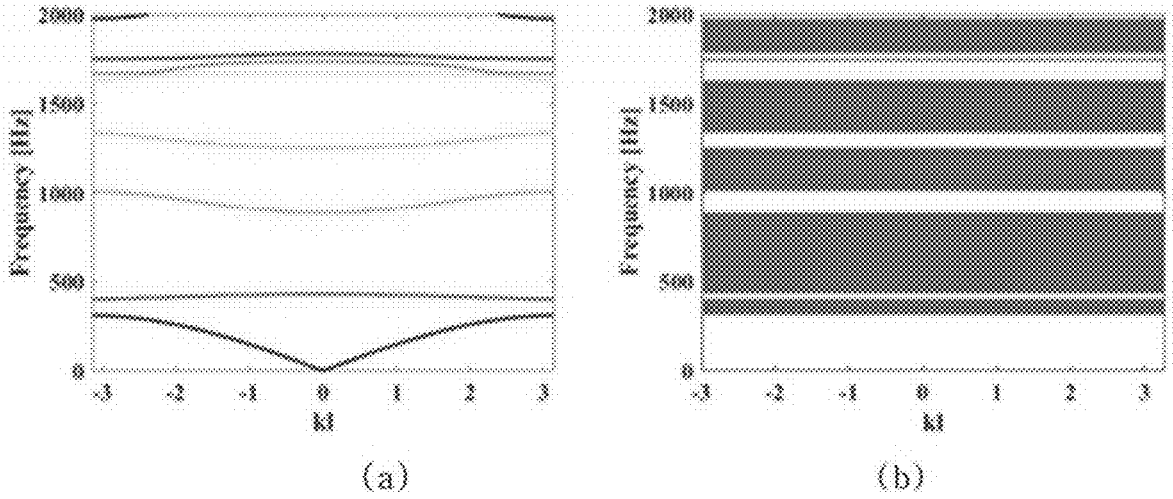
FIG. 6 is a graph illustrating analysis results of a dispersion curve (a) and a band cap (b) of the second noise reduction unit according to an embodiment of the present disclosure.

In addition, the second noise reduction unit 2200 with reference to FIGS. 5 and 6 attenuates exhaust noise in the frequency bands of 368 to 373 Hz, 805 to 882 Hz, 1350 to 1400 Hz, and 1785 to 1823 Hz among the frequency bands in which the noise reduction band of the first noise reduction unit 2100 is not formed.

In this case, the second noise reduction unit 2200 includes a second front outer wall 2201, a second rear outer wall 2202, a 2-1 inner wall 2203, a 2-2 inner wall 2204, a 2-3 inner wall 2205, and a 2-4 inner wall 2206. The number, position, and length of the inner walls are only examples, and the number of inner walls is not limited to 4 according to design conditions of the muffler, and may be adjusted in various ways to be more or less than that.

As an example of the second noise reduction unit 2200, it is preferable that the second front outer wall 2201 is formed orthogonal to the longitudinal direction of the exhaust flow pipe 1000, the second rear outer wall 2202 is formed to be spaced apart from the second front outer wall 2201 at a certain distance, and the second rear outer wall 2202 is also formed orthogonal to the longitudinal direction of the exhaust flow pipe 1000.

In this case, it is preferable that the separation distance between the second front outer wall 2201 and the second rear outer wall 2202 is 144 mm, and an annular disk is formed at the center of the second front outer wall 2201 and the second rear outer wall 2202 to allow the exhaust to flow.

In addition, the 2-1 inner wall 2203 is formed at the ends of the second front outer wall 2201 and the second rear outer wall 2202 to have a length toward the inner center of the second front outer wall 2201 and the second rear outer wall 2202, and its length is parallel to the longitudinal direction of the exhaust flow pipe 1000.

In this case, it is preferable that the length of the 2-1 inner wall 2203 is 20 mm, and wave energy such as sound waves of exhaust flowing along the exhaust passage is incident between the 2-1 inner walls 2203 formed at the ends of the second front outer wall 2201 and the second rear outer wall 2202, respectively.

The 2-2 inner wall 2204 is spaced apart from the 2-1 inner wall 2203 at a corresponding distance in the outer circumferential direction on the inside between the second front outer wall 2201 and the second rear outer wall 2202, and is formed to have a length toward the inner center of the second front outer wall 2201 and the second rear outer wall 2202, and its length is parallel to the length of the 2-1 inner wall 2203.

In this case, it is preferable that the length of the 2-2 inner wall 2204 is 20 mm, the separation distance from the 2-1 inner wall 2203 is 16 mm based on the 2-1 inner wall 2203, and wave energy such as sound waves of exhaust passing between the 2-1 inner walls 2203 is incident between the 2-2 inner walls 2204 formed on the inner surfaces of the second front outer wall 2201 and the second rear outer wall 2202, respectively.

The 2-3 inner wall 2205 is spaced apart from the 2-2 inner wall 2204 at a corresponding distance in the outer circumferential direction on the inside between the second front outer wall 2201 and the second rear outer wall 2202 and is formed to have a length toward the inner center of the second front outer wall 2201 and the second rear outer wall 2202, and its length is parallel to the length of the 2-1 inner wall 2203.

In this case, it is preferable that the length of the 2-3 inner wall 2205 is 20 mm, the separation distance from the 2-1 inner wall 2203 is 62 mm based on the 2-1 inner wall 2203, and wave energy such as sound waves of exhaust passing between the 2-3 inner walls 2205 is incident between the 2-3 inner walls 2205 formed on the inner surfaces of the second front outer wall 2201 and the second rear outer wall 2202, respectively.

The 2-4 inner wall 2206 is spaced apart from the 2-3 inner wall 2205 at a corresponding distance in the outer circumferential direction on the inside between the second front outer wall 2201 and the second rear outer wall 2202 and is formed to have a length toward the inner center of the second front outer wall 2201 and the second rear outer wall 2202, and its length is parallel to the length of the 2-1 inner wall 2203.

In this case, it is preferable that the length of the 2-4 inner wall 2206 is 56 mm, the separation distance from the 2-1 inner wall 2203 is 124 mm based on the 2-1 inner wall 2203, and wave energy such as sound waves of exhaust passing between the 2-3 inner walls 2205 is incident between the 2-4 inner walls 2206 formed on the inner surfaces of the second front outer wall 2201 and the second rear outer wall 2202, respectively.

Therefore, the lengths of the 2-1 inner wall 2203, the 2-2 inner wall 2204, the 2-3 inner wall 2205, and the 2-4 inner wall 2206 are parallel to each other, and the above-described inner walls are formed on the second front outer wall 2201 and the second rear outer wall 2202, respectively, and are bilaterally symmetrical based on the inner center of the second front outer wall 2201 and the second rear outer wall 2202.

In addition, as described above, it is preferable that the 2-1 inner wall 2203, the 2-2 inner wall 2204, the 2-3 inner wall 2205, and the 2-4 inner wall 2206 of the second noise reduction unit 2200 are axially symmetrical having a shape rotated about the central axis of the exhaust flow pipe 1000.

In addition, the cavity divided by the 2-1 inner wall 2203, the 2-2 inner wall 2204, the 2-3 inner wall 2205, and the 2-4 inner wall 2206 may be formed of a structure in which a plurality of Helmholtz resonators are connected in series and a ¼ wave tube structure to reduce exhaust noise.

Therefore, FIG. 6 illustrates a dispersion curve and a band gap section according to the second noise reduction unit 2200, and the second noise reduction unit 2200 forms noise reduction bands in the ranges of 309 to 399 Hz, 427 to 882 Hz, 1010 to 1255 Hz, 1338 to 1630 Hz, and 1669 to 1670 Hz among the frequency bands of 1 to 2000 Hz, thereby reducing exhaust noise by attenuating the exhaust noise in the corresponding frequency bands.

Here, the second noise reduction unit 2200 has the noise reduction bands in 368 to 373 Hz, 805 to 882 Hz, 1350 to 1400 Hz, and 1785 to 1823 Hz among the frequency bands in which the noise reduction band of the first noise reduction unit 2100 is not formed, and in a case where the first noise reduction unit 2100 and the second noise reduction unit 2200 are used together, wide noise reduction bands of 296 to 882 Hz and 962 to 2000 Hz may be obtained.

Figure 7:
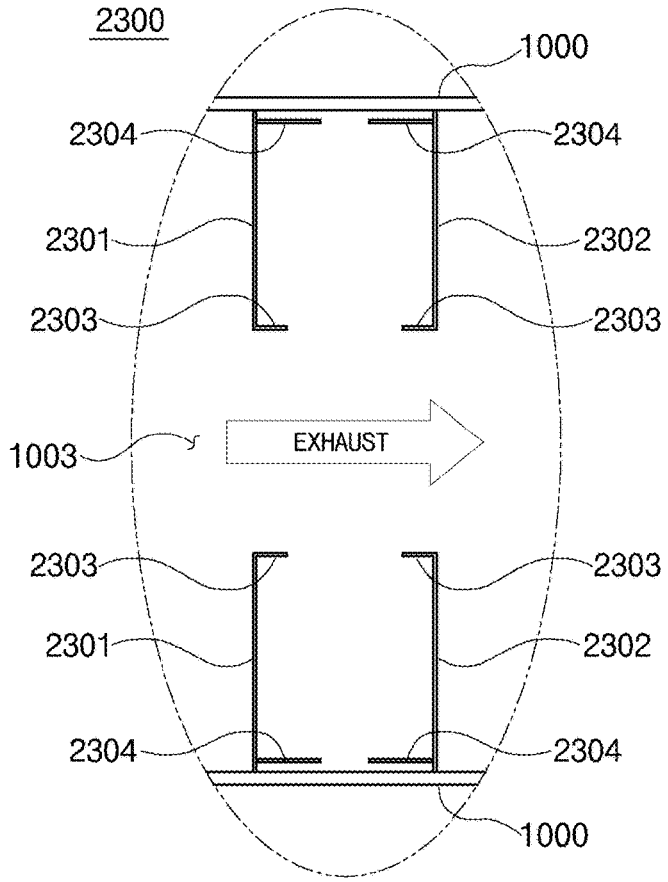
FIG. 7 is a sectional view illustrating a cross-section of a third noise reduction unit according to an embodiment of the present disclosure.
Figure 8:
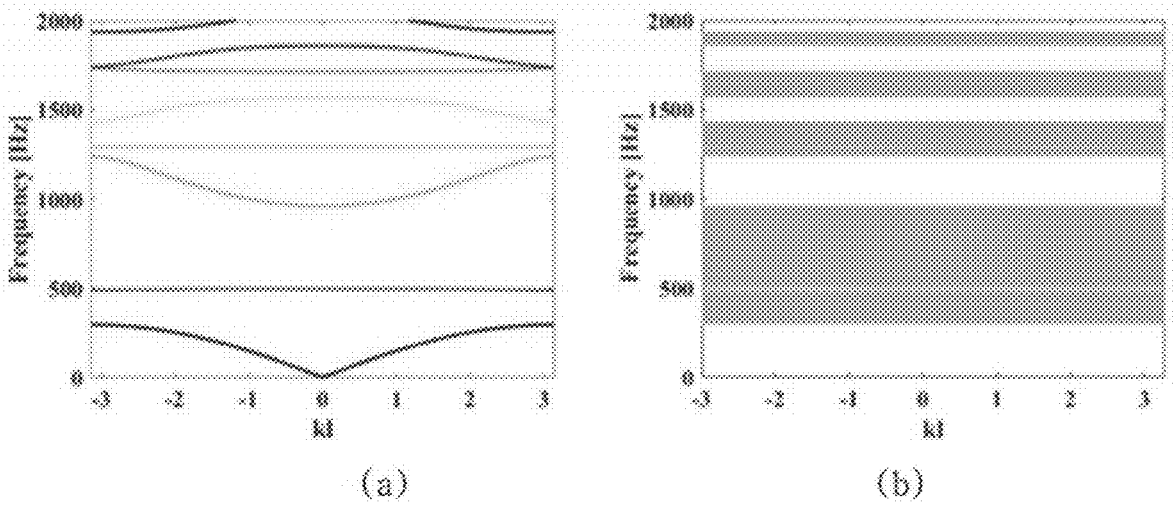
FIG. 8 is a graph illustrating analysis results of a dispersion curve (a) and a band cap (b) of the third noise reduction unit according to an embodiment of the present disclosure.

In addition, the third noise reduction unit 2300 with reference to FIGS. 7 and 8 attenuates exhaust noise in the frequency band of 883 to 961 Hz among the frequency bands in which the noise reduction bands of the first and second noise reduction units 2100 and 2200 are not formed.

In this case, the third noise reduction unit 2300 includes a third front outer wall 2301, a third rear outer wall 2302, a 3-1 inner wall 2303, and a 3-2 inner wall 2304. The number, position, and length of the inner walls are only examples, and the number of inner walls is not limited to 2 according to design conditions of the muffler, and may be adjusted in various ways to be more or less than that.

As an example of the third noise reduction unit 2300, it is preferable that the third front outer wall 2301 is formed orthogonal to the longitudinal direction of the exhaust flow pipe 1000, the third rear outer wall 2302 is formed to be spaced apart from the third front outer wall 2301 at a certain distance, and the third rear outer wall 2302 is also formed orthogonal to the longitudinal direction of the exhaust flow pipe 1000.

In this case, it is preferable that the separation distance between the third front outer wall 2301 and the third rear outer wall 2302 is 184 mm, and an annular disk is formed at the center of the third front outer wall 2301 and the third rear outer wall 2302 to allow the exhaust to flow.

In addition, the 3-1 inner wall 2303 is formed at the ends of the third front outer wall 2301 and the third rear outer wall 2302 to have a length toward the inner center of the third front outer wall 2301 and the third rear outer wall 2302, and its length is parallel to the longitudinal direction of the exhaust flow pipe 1000.

In this case, it is preferable that the length of the 3-1 inner wall 2303 is 34 mm, and wave energy such as sound waves of exhaust flowing along the exhaust passage is incident between the 3-1 inner walls 2303 formed at the ends of the third front outer wall 2301 and the third rear outer wall 2302, respectively.

The 3-2 inner wall 2304 is spaced apart from the 3-1 inner wall 2303 at a corresponding distance in the outer circumferential direction on the inside between the third front outer wall 2301 and the third rear outer wall 2302, and is formed to have a length toward the inner center of the third front outer wall 2301 and the third rear outer wall 2302, and its length is parallel to the length of the 3-1 inner wall 2303.

In this case, it is preferable that the length of the 3-2 inner wall 2304 is 52 mm, the separation distance from the 3-1 inner wall 2303 is 144 mm based on the 3-1 inner wall 2303, and wave energy such as sound waves of exhaust passing between the 3-1 inner walls 2303 is incident between the 3-2 inner walls 2304 formed on the inner surfaces of the third front outer wall 2301 and the third rear outer wall 2302, respectively.

Therefore, the lengths of the 3-1 inner wall 2303 and the 3-2 inner wall 2304 are parallel to each other, and the above-described inner walls are formed on the third front outer wall 2301 and the third rear outer wall 2302, respectively, and are bilaterally symmetrical based on the inner center of the third front outer wall 2301 and the third rear outer wall 2302.

In addition, as described above, it is preferable that the 3-1 inner wall 2303 and the 3-2 inner wall 2304 of the third noise reduction unit 2300 are axially symmetrical having a shape rotated about the central axis of the exhaust flow pipe 1000.

In addition, the cavity divided by the 3-1 inner wall 2303 and the 3-2 inner wall 2304 may be formed of a structure in which a plurality of Helmholtz resonators are connected in series and a ¼ wave tube structure to reduce exhaust noise.

Therefore, FIG. 8 illustrates a dispersion curve and a band gap section according to the third noise reduction unit 2300, and the third noise reduction unit 2300 forms noise reduction bands in the ranges of 297 to 489 Hz, 496 to 964 Hz, 1240 to 1292 Hz, 1295 to 1432 Hz, 1568 to 1714 Hz, 1735 to 1737 Hz, and 1860 to 1936 Hz among the frequency bands of 1 to 2000 Hz, thereby reducing exhaust noise by attenuating the exhaust noise in the corresponding frequency bands.

Here, the third noise reduction unit 2300 has the noise reduction bands in 883 to 961 Hz among the frequency bands in which the noise reduction bands of the first noise reduction unit 2100 and the second noise reduction unit 2200 are not formed, and in a case where the first noise reduction unit 2100, the second noise reduction unit 2200, and the third noise reduction unit 2300 are used together, wide noise reduction bands of 296 to 2000 Hz may be obtained.

Figure 9:
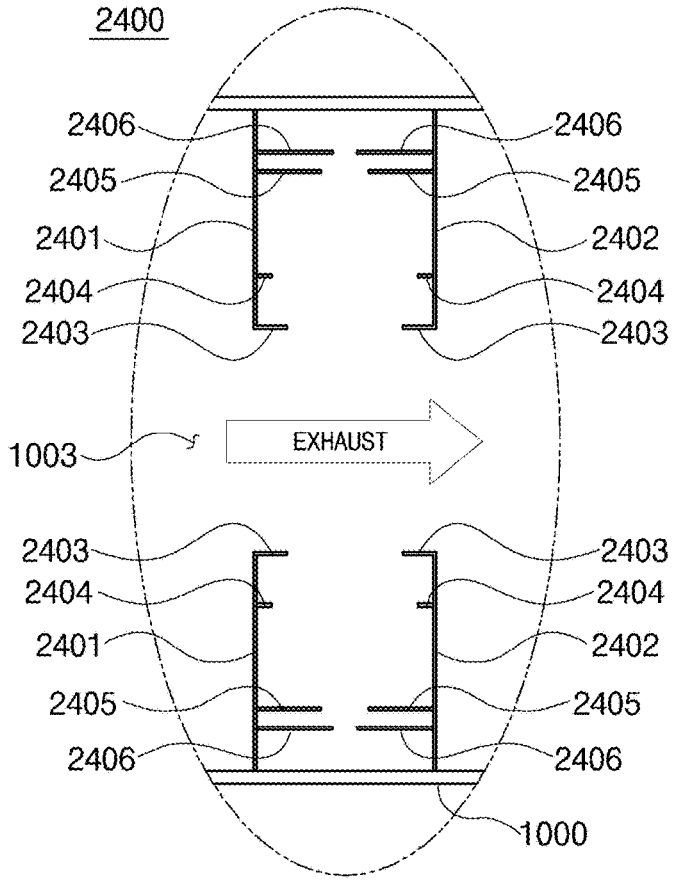
FIG. 9 is a sectional view illustrating a fourth noise reduction unit according to an embodiment of the present disclosure.
Figure 10:
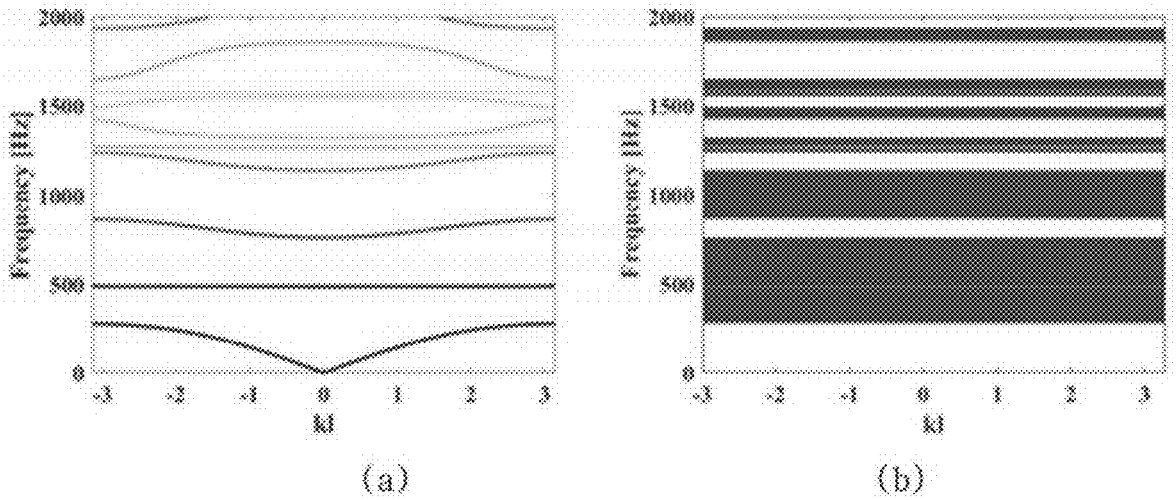
FIG. 10 is a graph illustrating analysis results of a dispersion curve (a) and a band cap (b) of the fourth noise reduction unit according to an embodiment of the present disclosure.

In addition, the fourth noise reduction unit 2400 with reference to FIGS. 9 and 10 attenuates exhaust noise in the frequency band of 277 to 295 Hz among the frequency bands in which the noise reduction bands of the first, second, and third noise reduction units 2100, 2200, and 2300 are not formed.

In this case, the fourth noise reduction unit 2400 includes a fourth front outer wall 2401, a fourth rear outer wall 2402, a 4-1 inner wall 2403, a 4-2 inner wall 2404, a 4-3 inner wall 2405, and a 4-4 inner wall 2406. The number, position, and length of the inner walls are only examples, and the number of inner walls is not limited to 4 according to design conditions of the muffler, and may be adjusted in various ways to be more or less than that.

As an example of the fourth noise reduction unit 2400, it is preferable that the fourth front outer wall 2401 is formed orthogonal to the longitudinal direction of the exhaust flow pipe 1000, the fourth rear outer wall 2402 is formed to be spaced apart from the fourth front outer wall 2401 at a certain distance, and the fourth rear outer wall 2402 is also formed orthogonal to the longitudinal direction of the exhaust flow pipe 1000.

In this case, it is preferable that the separation distance between the fourth front outer wall 2401 and the fourth rear outer wall 2402 is 188 mm, and an annular disk is formed at the center of the fourth front outer wall 2401 and the fourth rear outer wall 2402 to allow the exhaust to flow.

In addition, the 4-1 inner wall 2403 is formed at the ends of the fourth front outer wall 2401 and the fourth rear outer wall 2402 to have a length toward the inner center of the fourth front outer wall 2401 and the fourth rear outer wall 2402, and its length is parallel to the longitudinal direction of the exhaust flow pipe 1000.

In this case, it is preferable that the length of the 4-1 inner wall 2403 is 42 mm, and wave energy such as sound waves of exhaust flowing along the exhaust passage is incident between the 4-1 inner walls 2403 formed at the ends of the fourth front outer wall 2401 and the fourth rear outer wall 2402, respectively.

The 4-2 inner wall 2404 is spaced apart from the 4-1 inner wall 2403 at a corresponding distance in the outer circumferential direction on the inside between the fourth front outer wall 2401 and the fourth rear outer wall 2402, and is formed to have a length toward the inner center of the fourth front outer wall 2401 and the fourth rear outer wall 2402, and its length is parallel to the length of the 4-1 inner wall 2403.

In this case, it is preferable that the length of the 4-2 inner wall 2404 is 18 mm, the separation distance from the 4-1 inner wall 2403 is 68 mm based on the 4-1 inner wall 2403, and wave energy such as sound waves of exhaust passing between the 4-1 inner walls 2403 is incident between the 4-2 inner walls 2404 formed on the inner surfaces of the fourth front outer wall 2401 and the fourth rear outer wall 2402, respectively.

The 4-3 inner wall 2405 is spaced apart from the 4-2 inner wall 2404 at a corresponding distance in the outer circumferential direction on the inside between the fourth front outer wall 2401 and the fourth rear outer wall 2402, and is formed to have a length toward the inner center of the fourth front outer wall 2401 and the fourth rear outer wall 2402, and its length is parallel to the length of the 4-1 inner wall 2403.

In this case, it is preferable that the length of the 4-3 inner wall 2405 is 66 mm, the separation distance from the 4-1 inner wall 2403 is 120 mm based on the 4-1 inner wall 2403, and wave energy such as sound waves of exhaust passing between the 4-2 inner walls 2404 is incident between the 4-3 inner walls 2405 formed on the inner surfaces of the fourth front outer wall 2401 and the fourth rear outer wall 2402, respectively.

The 4-4 inner wall 2406 is spaced apart from the 4-3 inner wall 2405 at a corresponding distance in the outer circumferential direction on the inside between the fourth front outer wall 2401 and the fourth rear outer wall 2402, and is formed to have a length toward the inner center of the fourth front outer wall 2401 and the fourth rear outer wall 2402, and its length is parallel to the length of the 4-1 inner wall 2403.

In this case, it is preferable that the length of the 4-4 inner wall 2406 is 78 mm, the separation distance from the 4-1 inner wall 2403 is 128 mm based on the 4-1 inner wall 2403, and wave energy such as sound waves of exhaust passing between the 4-3 inner walls 2405 is incident between the 4-4 inner walls 2406 formed on the inner surfaces of the fourth front outer wall 2401 and the fourth rear outer wall 2402, respectively.

Therefore, the lengths of the 4-1 inner wall 2403, the 4-2 inner wall 2404, the 4-3 inner wall 2405, and the 4-4 inner wall 2406 are parallel to each other, and the above-described inner walls are formed on the fourth front outer wall 2401 and the fourth rear outer wall 2402, respectively, and are bilaterally symmetrical based on the inner center of the fourth front outer wall 2401 and the fourth rear outer wall 2402.

In addition, as described above, it is preferable that the 4-1 inner wall 2403, the 4-2 inner wall 2404, the 4-3 inner wall 2405, and the 4-4 inner wall 2406 of the fourth noise reduction unit 2400 are axially symmetrical having a shape rotated about the central axis of the exhaust flow pipe 1000.

In addition, the cavity divided by the 4-1 inner wall 2403, the 4-2 inner wall 2404, the 4-3 inner wall 2405, and the 4-4 inner wall 2406 may be formed of a structure in which a plurality of Helmholtz resonators are connected in series and a ¼ wave tube structure to reduce exhaust noise.

Therefore, FIG. 10 illustrates a dispersion curve and a band gap section according to the fourth noise reduction unit 2400, and the fourth noise reduction unit 2400 forms noise reduction bands in the ranges of 277 to 484 Hz, 487 to 757 Hz, 861 to 1141 Hz, 1240 to 1267 Hz, 1273 to 1321 Hz, 1425 to 1490 Hz, 1522 to 1573 Hz, and 1579 to 1647 Hz among the frequency bands of 1 to 2000 Hz, thereby reducing exhaust noise by attenuating the exhaust noise in the corresponding frequency bands.

Here, the fourth noise reduction unit 2400 has the noise reduction bands in 277 to 295 Hz among the frequency bands in which the noise reduction bands of the first noise reduction unit 2100 to the third noise reduction unit 2300 are not formed, and in a case where the first noise reduction unit 2100 to the fourth noise reduction unit 2400 are used together, wide noise reduction bands of 277 to 2000 Hz may be obtained.

Figure 11:
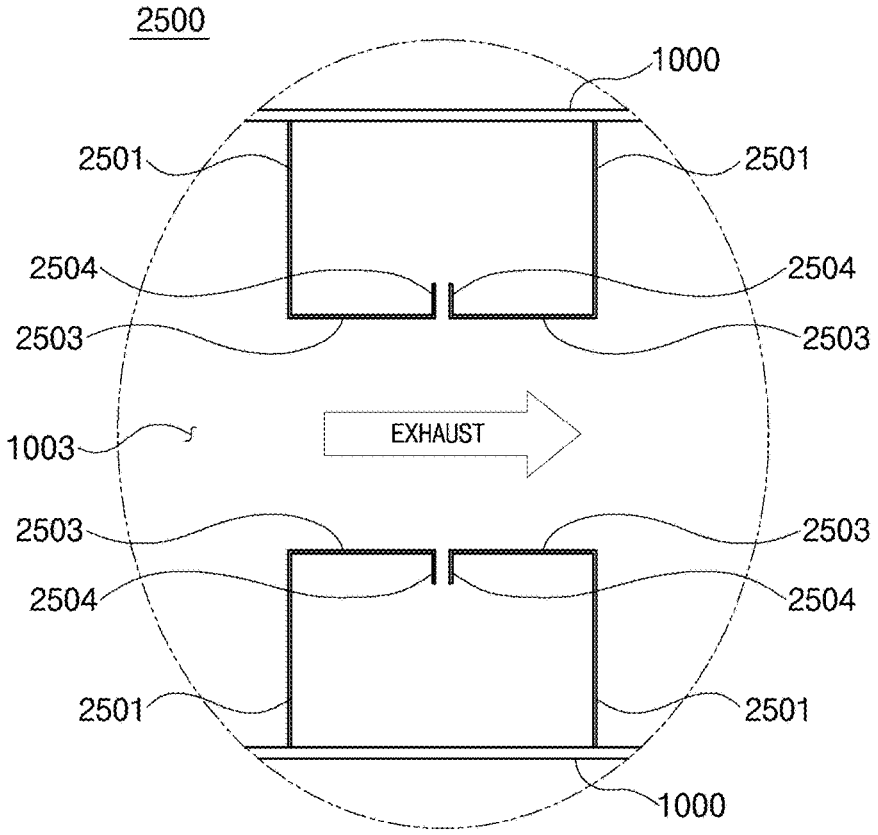
FIG. 11 is a sectional view illustrating a cross-section of a fifth noise reduction unit according to an embodiment of the present disclosure.
Figure 12:
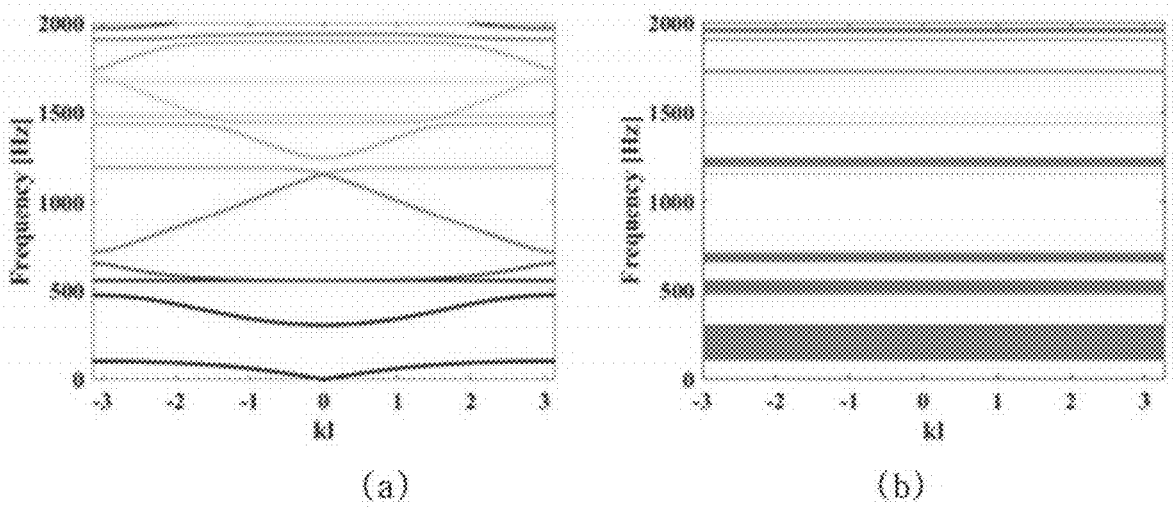
FIG. 12 is a graph illustrating analysis results of a dispersion curve (a) and a band cap (b) of the fifth noise reduction unit according to an embodiment of the present disclosure.

In addition, the fifth noise reduction unit 2500 with reference to FIGS. 11 and 12 attenuates exhaust noise in the frequency band of 102 to 276 Hz among the frequency bands in which the noise reduction bands of the first, second, third, and fourth noise reduction units 2100, 2200, 2300, and 1400 are not formed.

In this case, the fifth noise reduction unit 2500 includes a fifth front outer wall 2501, a fifth rear outer wall 2502, a 5-1 inner wall 2503, and a 5-2 inner wall 2504. The number, position, and length of the inner walls are only examples, and the number of inner walls is not limited to 2 according to design conditions of the muffler, and may be adjusted in various ways to be more or less than that.

As an example of the fifth noise reduction unit 2500, it is preferable that the fifth front outer wall 2501 is formed orthogonal to the longitudinal direction of the exhaust flow pipe 1000, the fifth rear outer wall 2502 is formed to be spaced apart from the fifth front outer wall 2501 at a certain distance, and the fifth rear outer wall 2502 is also formed orthogonal to the longitudinal direction of the exhaust flow pipe 1000.

In this case, it is preferable that the separation distance between the fifth front outer wall 2501 and the fifth rear outer wall 2502 is 392 mm, and an annular disk is formed at the center of the fifth front outer wall 2501 and the fifth rear outer wall 2502 to allow the exhaust to flow.

In addition, the 5-1 inner wall 2503 is formed at the ends of the fifth front outer wall 2501 and the fifth rear outer wall 2502 to have a length toward the inner center of the fifth front outer wall 2501 and the fifth rear outer wall 2502, and its length is parallel to the longitudinal direction of the exhaust flow pipe 1000.

In this case, it is preferable that the length of the 5-1 inner wall 2503 is 182 mm, and wave energy such as sound waves of exhaust flowing along the exhaust passage 1003 is incident between the 5-1 inner walls 2503 formed on the ends of the fifth front outer wall 2501 and the fifth rear outer wall 2502, respectively.

The 5-2 inner wall 2504 is formed at the end of the 5-1 inner wall 2503 to have a length toward the inside between the fifth front outer wall 2501 and the fifth rear outer wall 2502, and its length is parallel to the lengths of the fifth front outer wall 2501 and the fifth rear outer wall 2502.

In this case, it is preferable that the length of the 5-2 inner wall 25034 is 54 mm, and wave energy such as sound waves of exhaust flowing along the exhaust passage 1003 is incident between the 5-2 inner walls 2504 formed on the ends of the 5-1 inner walls 2503, respectively.

Therefore, the 5-1 inner wall 2503 and the 5-2 inner wall 2504 orthogonal to each other are formed in the fifth front outer wall 2501 and the fifth rear outer wall 2502, respectively, and are bilaterally symmetrical based on the inner center of the fifth front outer wall 2501 and the fifth rear outer wall 2502.

In addition, as described above, it is preferable that the 5-1 inner wall 2503 and the 5-2 inner wall 2504 are axially symmetrical having a shape rotated about the central axis of the exhaust flow pipe 1000.

In addition, the cavity formed by the 5-1 inner wall 2503 and the 5-2 inner wall 2504 may be formed of a Helmholtz resonator structure and a ¼ wave tube structure to reduce exhaust noise.

Therefore, FIG. 12 illustrates a dispersion curve and a band gap section according to the fifth noise reduction unit 2500, and the fifth noise reduction unit 2500 forms noise reduction bands in the ranges of 102 to 303 Hz, 470 to 552 Hz, 650 to 708 Hz, 1156 to 1160 Hz, 1195 to 1247 Hz, 1438 to 1442 Hz, 1718 to 1734 Hz, 1897 to 1908 Hz, and 1940 to 1970 Hz among the frequency bands of 1 to 2000 Hz, thereby reducing exhaust noise by attenuating the exhaust noise in the corresponding frequency bands.

Here, the fifth noise reduction unit 2500 has the noise reduction bands in 102 to 276 Hz among the frequency bands in which the noise reduction bands of the first noise reduction unit 2100 to the fourth noise reduction unit 2400 are not formed, and in a case where the first noise reduction unit 2100 to the fifth noise reduction unit 2500 are used together, wide noise reduction bands of 102 to 2000 Hz may be obtained.

Figure 13:
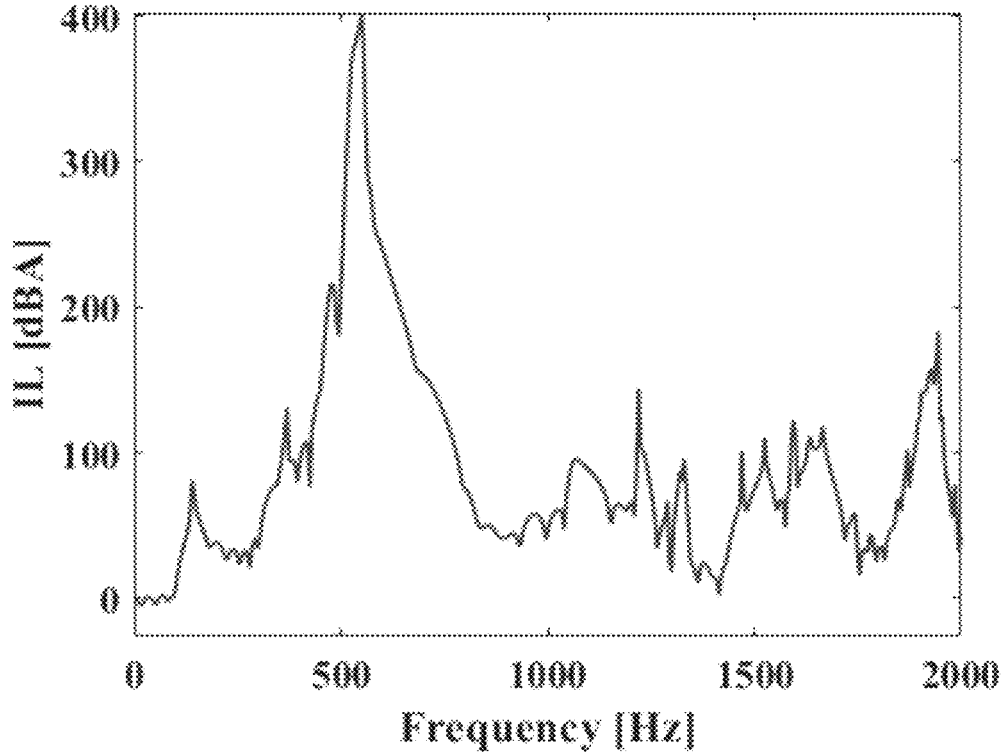
FIG. 13 is a graph illustrating an insertion loss curve obtained in a frequency band of 1 to 2000 Hz by an acoustic metamaterial-based muffler for broadband exhaust noise reduction of internal combustion engines according to an embodiment of the present disclosure.

FIG. 13 is a graph illustrating an insertion loss curve obtained in a frequency band of 1 to 2000 Hz by an acoustic metamaterial-based muffler for broadband exhaust noise reduction of internal combustion engines according to an embodiment of the present disclosure, and it may be seen that exhaust noise is effectively reduced by the present disclosure.

Figure 14:
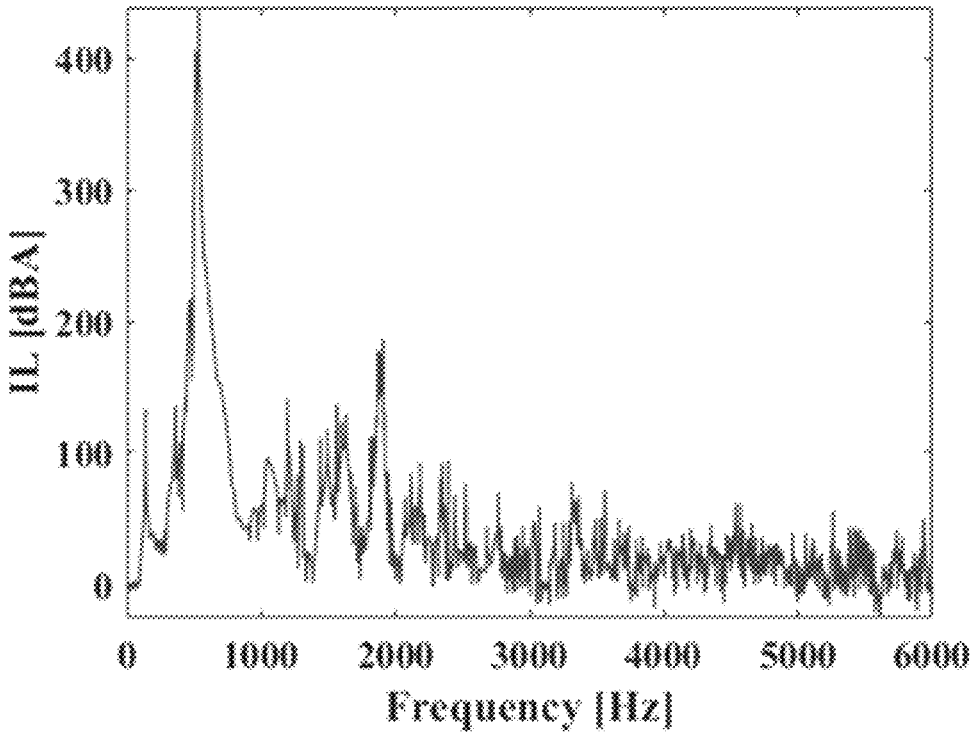
FIG. 14 is a graph illustrating an insertion loss curve obtained in a frequency band of 1 to 6000 Hz by an acoustic metamaterial-based muffler for broadband exhaust noise reduction of internal combustion engines according to an embodiment of the present disclosure.

FIG. 14 is a graph illustrating an insertion loss curve obtained in a frequency band of 1 to 6000 Hz by an acoustic metamaterial-based muffler for broadband exhaust noise reduction of internal combustion engines according to an embodiment of the present disclosure, and it may be seen that exhaust noise is effectively reduced by the present disclosure.

The present disclosure has been described with reference to the embodiments illustrated in the drawings, but these are merely exemplary, and those skilled in the art will understand that various modifications and equivalent other embodiments are possible therefrom. Therefore, the true scope of technical protection of the present disclosure should be determined by the technical spirit of the attached claims.

What is claimed is:

1. An acoustic metamaterial-based muffler for broadband exhaust noise reduction of internal combustion engines that is mounted on an exhaust pipe of an internal combustion engine, comprising:

an exhaust flow pipe that is formed of an inlet on one side through which exhaust of the internal combustion engine flows in, an outlet on the other side through which the exhaust flows out, and a flow passage on an inside through which the exhaust flows from one side to the other side; and a plurality of noise reduction units that are provided inside along a longitudinal direction of the exhaust flow pipe to attenuate noise in the corresponding frequency band among the exhaust noises flowing along the exhaust flow pipe, wherein the plurality of noise reduction units includes a first noise reduction unit that attenuates exhaust noise in the frequency bands of 296 to 367 Hz, 374 to 804 Hz, 962 to 1349 Hz, 1401 to 1784 Hz, and 1824 to 2000 Hz among the frequency ranges of 1 to 2000 Hz, and wherein the first noise reduction unit includes:

a first front outer wall that is formed orthogonal to a longitudinal direction of the exhaust flow pipe, a first rear outer wall that is spaced apart from the first front outer wall at a certain distance, and formed orthogonal to the longitudinal direction of the exhaust flow pipe, a 1-1 inner wall that is formed by a first pair of opposing walls formed at respective ends of the first front outer wall and the first rear outer wall to have a length toward an inner center between the first front outer wall and the first rear outer wall, and of which length is parallel to the longitudinal direction of the exhaust flow pipe, a 1-2 inner wall that is spaced apart from the 1-1 inner wall at a corresponding distance in an outer circumferential direction on an inside between the first front outer wall and the first rear outer wall, and is formed by a second pair of opposing walls formed at the first front outer wall and the first rear outer wall, respectively, to have a length toward the inner center between the first front outer wall and the first rear outer wall, and of which length is parallel to a length of the 1-1 inner wall, a 1-3 inner wall that is spaced apart from the 1-2 inner wall at a corresponding distance in the outer circumferential direction on the inside between the first front outer wall and the first rear outer wall, and is formed by a third pair of opposing walls formed at the first front outer wall and the first rear outer wall, respectively, to have a length toward the inner center between the first front outer wall and the first rear outer wall, and of which length is parallel to the length of the 1-1 inner wall, and a 1-4 inner wall that is spaced apart from the 1-3 inner wall at a corresponding distance in the outer circumferential direction on the inside between the first front outer wall and the first rear outer wall, and is formed by a fourth pair of opposing walls formed at the first front outer wall and the first rear outer wall, respectively, to have a length toward the inner center between the first front outer wall and the first rear outer wall, and of which length is parallel to the length of the 1-1 inner wall.

2. The acoustic metamaterial-based muffler for broadband exhaust noise reduction of internal combustion engines according to claim 1, wherein the plurality of noise reduction units further includes:

a second noise reduction unit that attenuates exhaust noise in the frequency bands of 368 to 373 Hz, 805 to 882 Hz, 1350 to 1400 Hz, and 1785 to 1823 Hz among the frequency bands in which the noise reduction band of the first noise reduction unit is not formed, a third noise reduction unit that attenuates exhaust noise in the frequency band of 883 to 961 Hz among the frequency bands in which the noise reduction bands of the first and second noise reduction units are not formed, a fourth noise reduction unit that attenuates exhaust noise in the frequency band of 277 to 295 Hz among the frequency bands in which the noise reduction bands of the first, second, and third noise reduction units are not formed, and a fifth noise reduction unit that attenuates exhaust noise in the frequency band of 102 to 276 Hz among the frequency bands in which the noise reduction bands of the first, second, third, and fourth noise reduction units are not formed.

3. The acoustic metamaterial-based muffler for broadband exhaust noise reduction of internal combustion engines according to claim 1, wherein the separation distance between the first front outer wall and the first rear outer wall is 104 mm, and the length of the 1-1 inner wall is 8 mm, the length of the 1-2 inner wall is 14 mm and the separation distance from the 1-1 inner wall is 26 mm based on the 1-1 inner wall, the length of the 1-3 inner wall is 42 mm and the separation distance from the 1-1 inner wall is 62 mm based on the 1-1 inner wall, and the length of the 1-4 inner wall is 46 mm and the separation distance from the 1-1 inner wall is 76 mm based on the 1-1 inner wall.

4. The acoustic metamaterial-based muffler for broadband exhaust noise reduction of internal combustion engines according to claim 2, wherein the second noise reduction unit includes:

a second front outer wall that is formed orthogonal to a longitudinal direction of the exhaust flow pipe, a second rear outer wall that is spaced apart from the second front outer wall at a certain distance, and formed orthogonal to the longitudinal direction of the exhaust flow pipe, a 2-1 inner wall that is formed by a first pair of opposing walls at respective ends of the second front outer wall and the second rear outer wall to have a length toward an inner center between the second front outer wall and the second rear outer wall, and of which length is parallel to the longitudinal direction of the exhaust flow pipe, a 2-2 inner wall that is spaced apart from the 2-1 inner wall at a corresponding distance in an outer circumferential direction on an inside between the second front outer wall and the second rear outer wall, and is formed by a second pair of opposing walls formed at the second front outer wall and the second rear outer wall, respectively, to have a length toward the inner center between the second front outer wall and the second rear outer wall, and of which length is parallel to the length of the 2-1 inner wall, a 2-3 inner wall that is spaced apart from the 2-2 inner wall at a corresponding distance in the outer circumferential direction on the inside between the second front outer wall and the second rear outer wall, and is formed by a third pair of opposing walls formed at the second front outer wall and the second rear outer wall, respectively, to have a length toward the inner center between the second front outer wall and the second rear outer wall, and of which length is parallel to the length of the 2-1 inner wall, and a 2-4 inner wall that is spaced apart from the 2-3 inner wall at a corresponding distance in the outer circumferential direction on the inside between the second front outer wall and the second rear outer wall, and is formed by a fourth pair of opposing walls formed at the second front outer wall and the second rear outer wall, respectively, to have a length toward the inner center of the second front outer wall and the second rear outer wall, and of which length is parallel to the length of the 2-1 inner wall.

5. The acoustic metamaterial-based muffler for broadband exhaust noise reduction of internal combustion engines according to claim 4, wherein the separation distance between the second front outer wall and the second rear outer wall is 144 mm, and the length of the 2-1 inner wall is 24 mm, the length of the 2-2 inner wall is 20 mm and the separation distance from the 2-1 inner wall is 16 mm based on the 2-1 inner wall, the length of the 2-3 inner wall is 20 mm and the separation distance from the 2-1 inner wall is 112 mm based on the 2-1 inner wall, and the length of the 2-4 inner wall is 56 mm and the separation distance from the 2-1 inner wall is 124 mm based on the 2-1 inner wall.

6. The acoustic metamaterial-based muffler for broadband exhaust noise reduction of internal combustion engines according to claim 2, wherein the third noise reduction unit includes:

a third front outer wall that is formed orthogonal to a longitudinal direction of the exhaust flow pipe, a third rear outer wall that is spaced apart from the third front outer wall at a certain distance, and formed orthogonal to the longitudinal direction of the exhaust flow pipe, a 3-1 inner wall that is formed by a first pair of opposing walls formed at respective ends of the third front outer wall and the third rear outer wall to have a length toward an inner center between the third front outer wall and the third rear outer wall, and of which length is parallel to the longitudinal direction of the exhaust flow pipe, and a 3-2 inner wall that is spaced apart from the 3-1 inner wall at a corresponding distance in an outer circumferential direction on an inside between the third front outer wall and the third rear outer wall, and is formed by a second pair of opposing walls formed at the third front outer wall and the third rear outer wall, respectively, to have a length toward the inner center between the third front outer wall and the third rear outer wall, and of which length is parallel to the length of the 3-1 inner wall.

7. The acoustic metamaterial-based muffler for broadband exhaust noise reduction of internal combustion engines according to claim 6, wherein the separation distance between the third front outer wall and the third rear outer wall is 184 mm, and the length of the 3-1 inner wall is 34 mm, and the length of the 3-2 inner wall is 52 mm and the separation distance from the 3-1 inner wall is 154 mm based on the 3-1 inner wall.

8. The acoustic metamaterial-based muffler for broadband exhaust noise reduction of internal combustion engines according to claim 2, wherein the fourth noise reduction unit includes:

a fourth front outer wall that is formed orthogonal to a longitudinal direction of the exhaust flow pipe, a fourth rear outer wall that is spaced apart from the fourth front outer wall at a certain distance, and formed orthogonal to the longitudinal direction of the exhaust flow pipe, a 4-1 inner wall that is formed by a first pair of opposing walls formed at respective ends of the fourth front outer wall and the fourth rear outer wall to have a length toward an inner center between the fourth front outer wall and the fourth rear outer wall, and of which length is parallel to the longitudinal direction of the exhaust flow pipe, a 4-2 inner wall that is spaced apart from the 4-1 inner wall at a corresponding distance in an outer circumferential direction on an inside between the fourth front outer wall and the fourth rear outer wall, and is formed by a second pair of opposing walls formed at the fourth front outer wall and the fourth rear outer wall, respectively, to have a length toward the inner center between the fourth front outer wall and the fourth rear outer wall, and of which length is parallel to the length of the 4-1 inner wall, a 4-3 inner wall that is spaced apart from the 4-2 inner wall at a corresponding distance in the outer circumferential direction on the inside between the fourth front outer wall and the fourth rear outer wall, and is formed by a third pair of opposing walls formed at the fourth front outer wall and the fourth rear outer wall, respectively, to have a length toward the inner center between the fourth front outer wall and the fourth rear outer wall, and of which length is parallel to the length of the 4-1 inner wall, and a 4-4 inner wall that is spaced apart from the 4-3 inner wall at a corresponding distance in the outer circumferential direction on the inside between the fourth front outer wall and the fourth rear outer wall, and is formed by a fourth pair of opposing walls formed at the fourth front outer wall and the fourth rear outer wall, respectively, to have a length toward the inner center of the fourth front outer wall and the fourth rear outer wall, and of which length is parallel to the length of the 4-1 inner wall.

9. The acoustic metamaterial-based muffler for broadband exhaust noise reduction of internal combustion engines according to claim 8, wherein the separation distance between the fourth front outer wall and the fourth rear outer wall is 188 mm, and the length of the 4-1 inner wall is 42 mm, the length of the 4-2 inner wall is 18 mm and the separation distance from the 4-1 inner wall is 68 mm based on the 4-1 inner wall, the length of the 4-3 inner wall is 66 mm and the separation distance from the 4-1 inner wall is 120 mm based on the 4-1 inner wall, and the length of the 4-4 inner wall is 78 mm and the separation distance from the 4-1 inner wall is 128 mm based on the 4-1 inner wall.

10. The acoustic metamaterial-based muffler for broadband exhaust noise reduction of internal combustion engines according to claim 2, wherein the fifth noise reduction unit includes:

a fifth front outer wall that is formed orthogonal to a longitudinal direction of the exhaust flow pipe, a fifth rear outer wall that is spaced apart from the fifth front outer wall at a certain distance, and formed orthogonal to the longitudinal direction of the exhaust flow pipe, a 5-1 inner wall that is formed by a first pair of opposing walls formed at respective ends of the fifth front outer wall and the fifth rear outer wall to have a length toward an inner center between the fifth front outer wall and the fifth rear outer wall, and of which length is parallel to the longitudinal direction of the exhaust flow pipe, and a 5-2 inner wall that is formed by a second pair of opposing walls formed at respective ends of the first pair of opposing walls of the 5-1 inner wall to have a length parallel to the lengths of the fifth front outer wall and the fifth rear outer wall.

11. The acoustic metamaterial-based muffler for broadband exhaust noise reduction of internal combustion engines according to claim 10, wherein the separation distance between the fifth front outer wall and the fifth rear outer wall is 392 mm, and the length of the 5-1 inner wall is 182 mm, and the length of the 5-2 inner wall is 54 mm.

12. The acoustic metamaterial-based muffler for broadband exhaust noise reduction of internal combustion engines according to claim 2, wherein each of the first to fifth noise reduction units is provided as a pair.

13. The acoustic metamaterial-based muffler for broadband exhaust noise reduction of internal combustion engines according to claim 12, wherein the first noise reduction unit, the second noise reduction unit, the third noise reduction unit, the fourth noise reduction unit, and the fifth noise reduction unit are provided in that order.

* * * * *